US006402611B1

(12) United States Patent
Rohrbaugh

(10) Patent No.: US 6,402,611 B1
(45) Date of Patent: Jun. 11, 2002

(54) HINGED MINE STOPPING

(76) Inventor: David J Rohrbaugh, 1947 Wilson Corona Rd., Oakland, MD (US) 21550

( * ) Notice: Subject to any disclaimer, the term of this patent is extended or adjusted under 35 U.S.C. 154(b) by 0 days.

(21) Appl. No.: 09/770,622

(22) Filed: Jan. 29, 2001

(51) Int. Cl.[7] ..... E21F 1/14
(52) U.S. Cl. ..... 454/169; 405/152; 49/501
(58) Field of Search ..... 454/169, 170; 405/152, 151, 132; 49/465, 501, 505

(56) References Cited

U.S. PATENT DOCUMENTS

| | | | | |
|---|---|---|---|---|
| 752,955 | A | 2/1904 | Clifford | |
| 1,478,303 | A | 12/1923 | Snyder | |
| 1,778,979 | A | 10/1930 | Lockhart | |
| 2,621,725 | A | 12/1952 | Shacikoski | |
| 3,006,267 | A | 10/1961 | Hargis | |
| 3,715,969 | A | 2/1973 | Burgess, Jr. | |
| 3,863,554 | A | 2/1975 | Boyd | |
| 4,388,779 | A | 6/1983 | Peterson | |
| RE32,675 | E | 5/1988 | Kennedy et al. | |
| 4,770,086 | A | 9/1988 | Gabster | |
| 4,911,577 | A * | 3/1990 | Kennedy et al. | 405/132 |
| 4,915,540 | A | 4/1990 | Kennedy et al. | |
| RE34,220 | E | 4/1993 | Kennedy et al. | |
| 5,466,187 | A | 11/1995 | Kennedy et al. | |
| 6,164,871 | A | 12/2000 | Kennedy et al. | |
| 6,176,043 | B1 * | 1/2001 | Gibbs | 49/501 |

FOREIGN PATENT DOCUMENTS

| | | |
|---|---|---|
| DE | 4102331 | 7/1992 |
| GB | 2087459 | 5/1982 |

* cited by examiner

*Primary Examiner*—Harold Joyce
*Assistant Examiner*—Derek S. Boles
(74) *Attorney, Agent, or Firm*—Richard C. Litman

(57) ABSTRACT

The hinged mine stopping has at least two panels joined by a hinge defining a wall adapted for forming an air tight seal in a mine passageway to improve mine ventilation. Each panel has a lower section defined by a sheet of gas impermeable material mounted on a tubular, rectangular frame, and an upper section defined by a sheet of gas impermeable material mounted on a tubular, inverted U-shaped frame. The side members of the upper section frame telescope into the side members of the lower section frame for height adjustment of the panels. Preferably the hinged mine stopping is disposed between the ribs of a mine in a V-shape, with the apex directed towards the high pressure side to reduce the load on the stopping, the perimeter of the stopping being sealed.

17 Claims, 8 Drawing Sheets

HINGED MINE STOPPING

BACKGROUND OF THE INVENTION

1. Field of the Invention

The present invention relates to mine ventilation devices, and particularly to a mine stopping for blocking the flow of air through a passageway in a mine, the mine stopping being characterized by at least two panels connected by a hinge.

2. Description of the Related Art

Mine ventilation systems are designed to deliver fresh air to the working face of the mine, and to exhaust noxious gases, such as methane, from the working face. Typically fresh air will be forced into an intake passage by a blower motor and the oxygen depleted or contaminated air is exhausted through a return passage. When a second shaft or tunnel does not intersect the intake passage, a connecting passage or crosscut may be made to connect the intake passage with the return passage. As the working face of the mine is advanced, the original crosscut falls farther behind and the blower motor lacks sufficient pressure to drive the fresh air to the working face due to the loss of pressure through the crosscut. Consequently, it is necessary to make additional crosscuts near the working face of the mine, and to block the passage of air through the crosscuts closer to the entrance of the air intake passage.

Further, it is common to have one or more workrooms branch off the main working section, which are mined for short periods of time and then abandoned as the main tunnel is lengthened. It is often desirable to block the flow of air to the abandoned workrooms to maintain sufficient pressure in the main working section. A variety of temporary devices, such as line brattices or curtains, and permanent devices, including stoppings made from concrete blocks or metal, as well as overcasts and undercasts, have been developed for altering air flow through a mine to enhance the mine's ventilation system. Permanent devices will often have a door disposed therein to provide an emergency exit in case of collapse of one of the passages, or to provide pressure release from concussive forces, such as blasting.

A number of patents describe temporary mine stoppings made from flexible materials, including U.S. Pat. No. 1,778,979, issued Oct. 21, 1930 to A. J. Lockhart (canvas curtain with wire about its periphery stapled to wooden plugs); U.S. Pat. No. 3,006,267, issued Oct. 31, 1961 (brattice of overlapping strips of jute or duck, permitting the passage of mine cars); U.S. Pat. No. 3,715,969, issued Feb. 13, 1973 to J. V. Burgess, Jr. (system for extending a line brattice); U.S. Pat. No. 3,863,554, issued Feb. 4, 1975 to N. A. Boyd (flexible sheet material with wire strap around its perimeter and novel frame members for compressing the strap against the mine opening); U.S. Pat. No. 4,770,086, issued Sep. 13, 1988 to J. C. Gabster (frame for extending a line curtain); and U.K. Patent No. 2,087,459 (parachute stopping tied to girders with skirt which unfurls to seal passage under pressure).

A permanent mine stopping (wall) is shown in U.S. Pat. No. Re. 34,220, issued Apr. 13, 1993 to Kennedy et al., being a reissue of U.S. Pat. No. 4,915,540, issued on Apr. 10, 1990. The patent describes a contractible mine stopping comprising a plurality of rows of blocks made from a noncompressible material and at least one row of blocks with is compressible. Three different embodiments of compressible blocks made from metal are shown. An overcast is disclosed in U.S. Pat. No. 5,466,187, issued Nov. 14, 1995 to Kennedy et al.

U.S. Pat. No. Re. 32,675, issued May 24, 1988 to Kennedy et al. The '675 patent shows a mine stopping with extensible walls consisting of a plurality of extensible panels aligned side by side. Each extensible panel has upper and lower telescoping channels. The extensible panels are secured to horizontal bars by metal ties. The gaps between adjacent panels are covered by lap members and sealed with filler.

Mine stoppings with doors are shown in U.S. Pat. No. 752,955, issued Feb. 23, 1904 to W. Clifford (mine stopping having at least two swing doors operating in tandem to redirect air flow through three passages); U.S. Pat. No. 1,478,303, issued Dec. 18, 1923 to S. H. Snyder (wooden frame covered with canvas having spring biased door for pressure relief during blasting); U.S. Pat. No. 2,621,725, issued to A. Shacikoski (shuttle door for a mine car); U.S. Pat. No. 4,388,779, issued Jun. 21, 1983 to C. R. Peterson (door featuring easier opening across a pressure drop); and German Patent No. 4,102,331, published Jul. 30, 1992 (corrugated sheet metal lining underground passage with weather door fitted across passage).

The permanent mine stoppings described above are generally designed for disposition normal to the flow of air through the passage. U.S. Pat. No. 6,164,871, issued Dec. 26, 2000 to Kennedy et al., describes a mine stopping with a door shown as a truncated V-shape, with two walls angled from the ribs of the mine and a door normal to the flow of air joining the two angled walls. It is said that the angled walls may be constructed according to the method described in U.S. Pat. No. Re. 32,675, discussed above (col. 4, lines 54–60). However, the '675 patent relied on horizontal bars extending between holes established in the ribs on opposite sides of the mine to support the extensible panels. Those horizontal bars are not shown in the '871 patent, and the patent does not disclose what adaptation is made to support the extensible panels. It will be noted that Kennedy does not show a hinge joining the angled walls to the door.

None of the above inventions and patents, taken either singularly or in combination, is seen to describe the instant invention as claimed. Thus a hinged mine stopping solving the aforementioned problems is desired.

SUMMARY OF THE INVENTION

The hinged mine stopping has at least two panels joined by a hinge defining a wall adapted for forming an air tight seal in a mine passageway to improve mine ventilation. Each panel has a lower section defined by a sheet of gas impermeable material mounted on a tubular, rectangular frame, and an upper section defined by a sheet of gas impermeable material mounted on a tubular, inverted U-shaped frame. The side members of the upper section frame telescope into the side members of the lower section frame for height adjustment of the panels. Preferably the hinged mine stopping is disposed between the ribs of a mine in a V-shape, with the apex directed towards the high pressure side to reduce the load on the stopping, the perimeter of the stopping being sealed.

The sheet material is preferably metal, particularly steel, but may be formed from a lightweight concrete or composite treated with a flameproof sealant. The sheet material may be flat, but the mine stopping can resist greater pressure if the sheets are made from corrugated material.

The hinge is disposed between the lower section of adjacent panels. The hinge may be a strap hinge composed of an elongated flexible metal strap welded to the frame side members of both panels. Alternatively, the hinge may be a plurality of ordinary door hinges attached to the frame side members. In the latter case, the hinged joint may be sealed by an elongated metal strip on the outside of the joint retained by a brace inside the joint.

The telescoping sections are locked at the desired height by either all thread bolts or friction bolts extending between the upper frame members of the upper and lower sections. The upper section sheet is disposed to form a friction fit against the lower section sheet material so that no seal is needed between the upper and lower sections. The mine stopping is held in place vertically by tension between the upper and lower sections maintained by the lock bolts, and horizontally by metal straps or tabs nailed to the ribs of the mine. The perimeter is sealed by expandable metal shims or wedges and conventional fiber filler.

Advantageously, the mine stopping may be folded compactly with one panel overlying the other for transport into the mine with the sealing material disposed between the panel. The low profile package permits up to eight stoppings to be hauled on a mine car, as compared to two block stoppings.

The hinged mine stopping may be installed faster, resulting in an a more efficient and economical use of labor. It is estimated that the hinged mine stopping would require about fifteen minutes to install, as compared to four hours for a block stopping and about forty-five minutes for the extensible panel stopping of the '675 Kennedy patent. In mining operations which operate twenty-four hours per day, seven days a week, with daily advances of several hundred feet, the savings in transport and installation time can be significant.

The hinged mine stopping requires less sealing material than other mine stoppings. The hinged mine stopping of the present invention only requires sealing about its perimeter, and depending on the embodiment, between adjacent upper panel sections.

Accordingly, it is a principal object of the invention to provide a hinged mine stopping adapted for being disposed in a V-shape in a mine passageway to provide higher load ratings than straight walls made from comparable materials.

It is another object of the invention to lower the installation time for a mine stopping by constructing the stopping from elongated hinged panels.

It is a further object of the invention to improve transport efficiency of mine stopping into a mine through a low profile hinged mine stopping.

Still another object of the invention is to provide a mine stopping for improved mine ventilation which is both V-shaped for increased load resistance and adjustable in height to adapt to the size of air passages in the mine.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
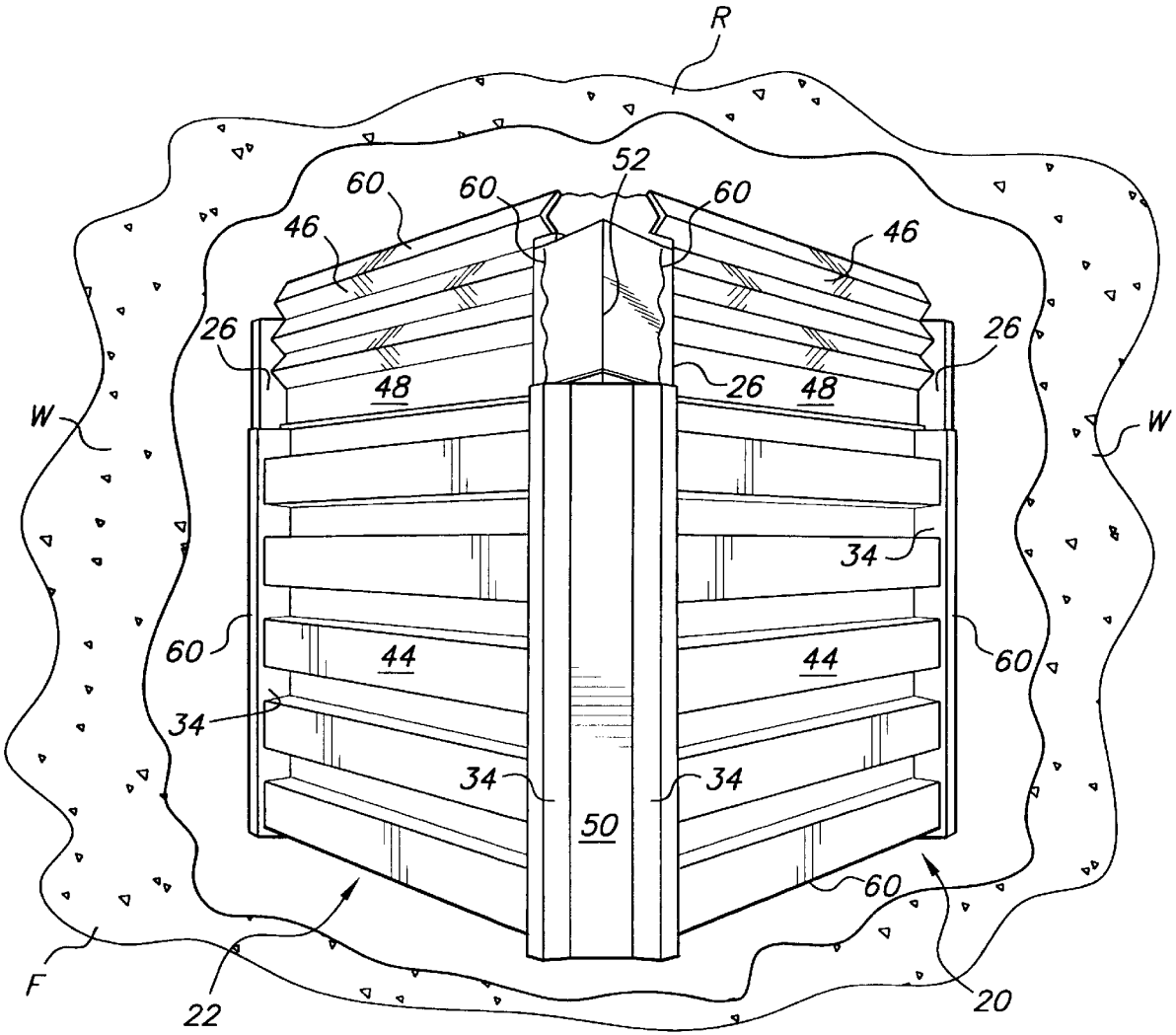
FIG. 1 is an environmental, perspective view of a hinged mine stopping according to the present invention.

The present invention is a hinged mine stopping 10 for redirecting the flow of air through a mine. As shown diagrammatically in FIG. 2, the mine has an air intake passage 12 into which air is blown by a blower fan (not shown). The intake passage 12 leads through the tunnel to the working face of the mine where it replenishes the supply of fresh air and exhausts any noxious gases through a return passage 14. The intake passage 12 may be viewed as the high pressure side of the ventilation system, while the return passage 14 is usually the low pressure side. The air flow, as indicated by the arrows in FIG. 2, requires that a crosscut 16 be formed to establish a connecting passage between the intake passage 12 and the return passage 14. As the tunnel lengthens, the working face of the mine advances, and it is necessary to establish additional crosscuts 18 close to the working face, and to block the flow of air through the preceding crosscuts 16 to maintain sufficient pressure in the air intake passage 12 for fresh air to reach the working face. The crosscuts 16 are typically blocked by a mine stopping (wall), or by a temporary ventilation control device.

Figure 2:
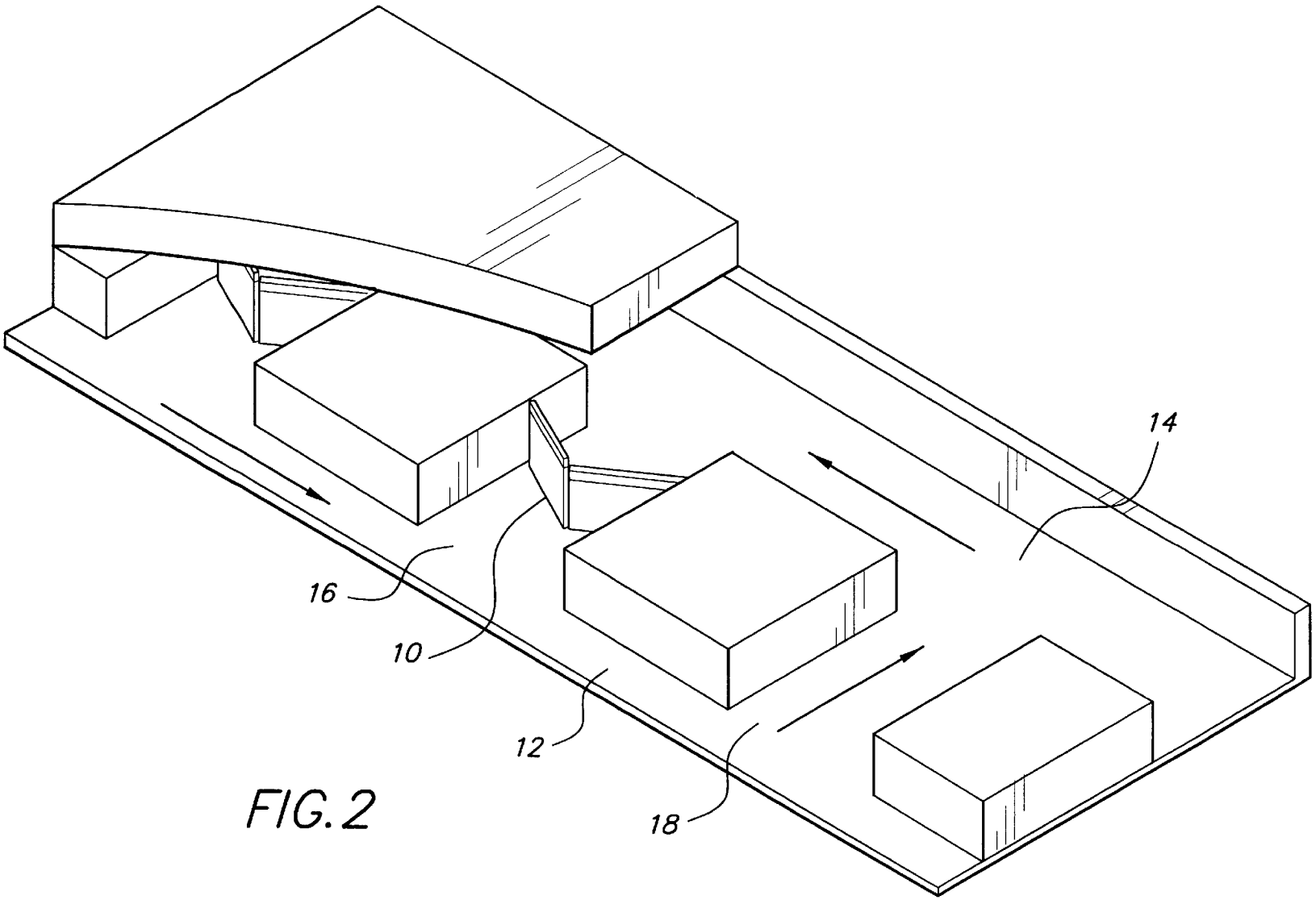
FIG. 2 is a diagrammatic view of air flow through a mine with the hinged mine stopping of the present invention.
Figure 3:
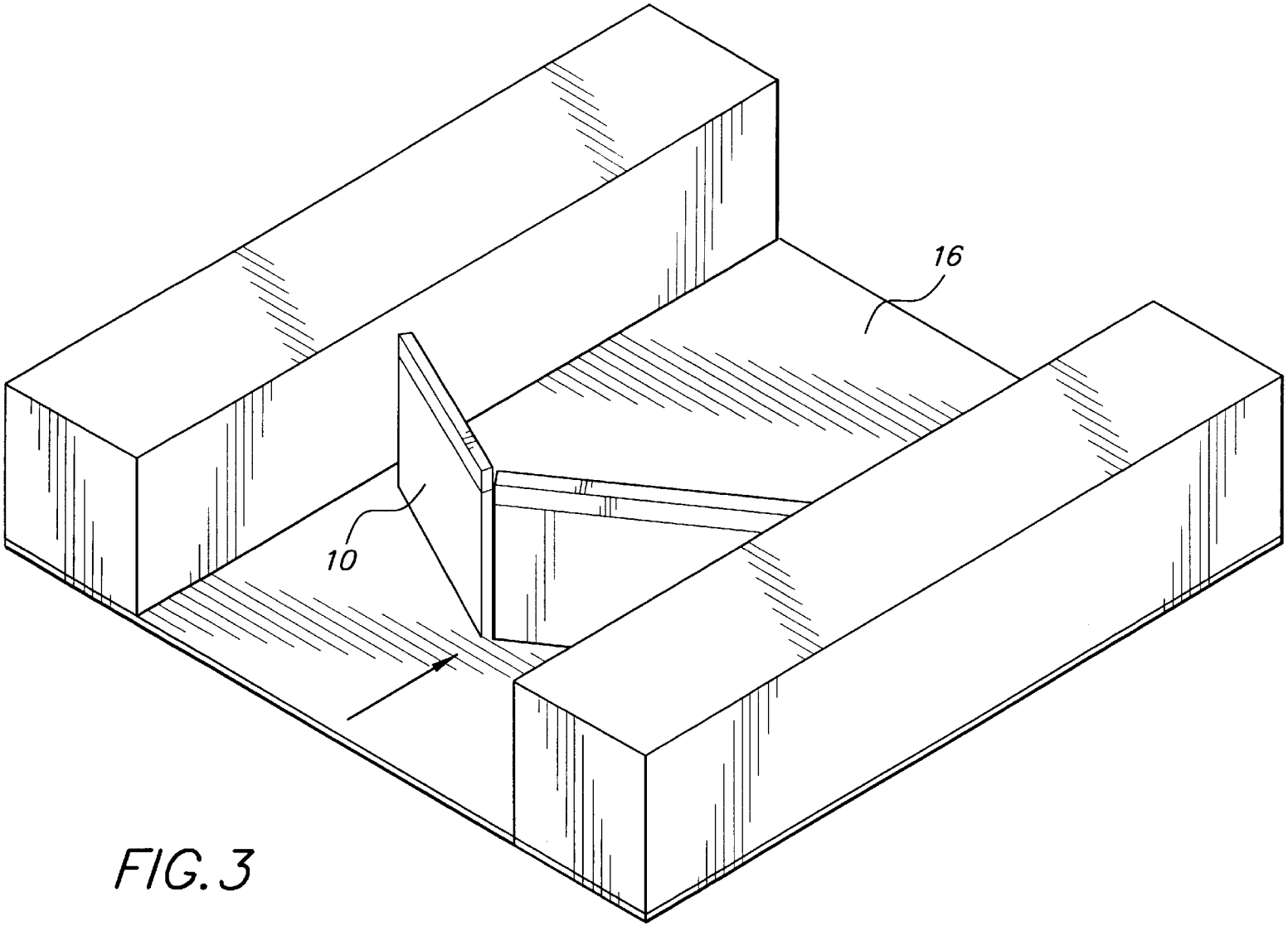
FIG. 3 is a top diagrammatic view of a hinged mine stopping according to the present invention.

Conventional mine stoppings are usually straight or planar walls disposed across the crosscut 16 normal to the flow of air. In such conventional mine stoppings, the load caused by the pressure of the air forced into the crosscut 16 from the intake passage 12 must be distributed uniformly over the face of the stopping. As shown in FIGS. 2 and 3, the hinged mine stopping 10 of the present invention is designed so that the stopping 10 is V-shaped when viewed from the top or in horizontal section, with the vertex of the V-shape directed towards the high pressure side, or intake passage 12. The disposition means that the two wings of the hinged mine stopping 10 do not have to bear the full load of the air forced into the crosscut 16, but only the component normal to each face of the hinged mine stopping 10, the remainder being dissipated against the walls of the crosscut 16. Hence, the hinged mine stopping 10 of the present invention is able to withstand a greater load than a conventional straight wall mine stopping of the same thickness made from the same material, which permits the hinged mine stopping 10 to be lighter than conventional mine stoppings.

As shown in FIG. 1, the hinged mine stopping 10 includes a first panel 20 and a second panel 22 connected by a hinge 50. The mine stopping 10 is shown disposed in a mine with a filler 60 comprised of expandable metal shims or wedges (not shown) and fiber filler or other Mine Safety and Health Administration (MSHA) approved sealant to seal any gaps between the mine stopping 10 and the roof R, floor F, or ribs W of the mine. In the drawings each panel 20 and 22 is shown having a telescoping upper and lower sections for height adjustment; however, it will be understood that the scope of this application is intended to extend to any mine stopping having at least two panels connected by a hinge. The hinged mine stopping 10 is sized and dimensioned so that when the hinge is opened and the two panels 20 and 22 are extended, each panel 20 and 22 will define an oblique angle with the abutting rib W. The angle formed between the panel 20 or 22 and the rib W may be any angle between 0° and 90°, but is preferably in the range of 30° to 60°. Further, although a V-shape is preferred, other angular dispositions with multiple hinged panels, such as a truncated V-shape or a W-shape, are also intended to be within the scope of the present invention.

Figure 4:
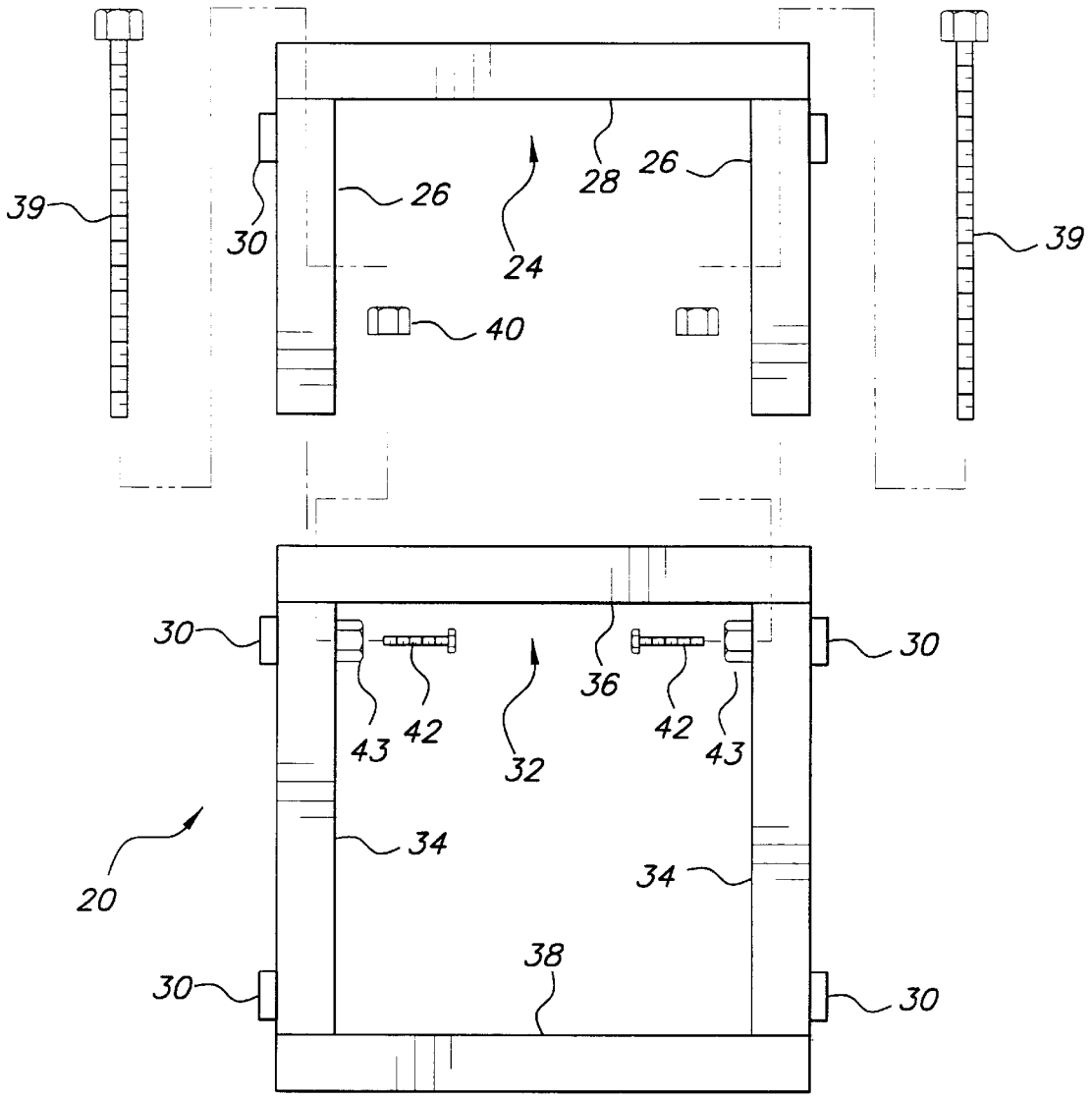
FIG. 4 is an exploded rear view of the frame of a single panel of the hinged mine stopping of the present invention with the sheet material omitted.
Figure 5:
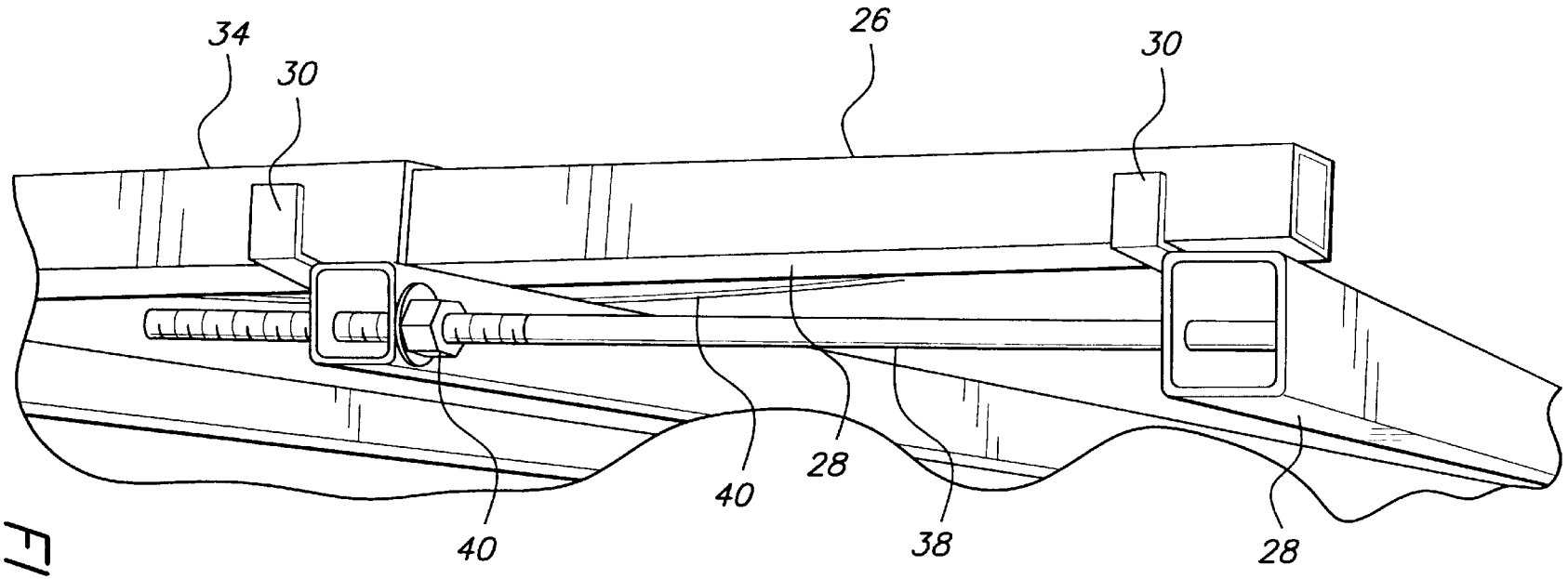
FIG. 5 is a perspective end view of the hinged mine stopping according to the present invention.

Each panel 20 and 22 preferably has an upper section and a lower section, each section comprising a gas impermeable, flame retardant sheet material disposed on a frame. The frame for the panel 20 is shown in FIG. 4, the frame for panel 22 being identical. The frame constitutes an inverted U-shaped upper section 24 and a rectangular lower section 32. The upper section 24 includes parallel posts or side members 26 joined by a crossbeam 28 across one end of the side members 26. As shown in FIGS. 4 and 5, the crossbeam 28 is not coplanar with the side members 26, but is joined to the rear face of the side members 26. The crossbeam 28 and the side members 26 are preferably made from hollow, square steel tubes. A dog leg tab 30 is attached to the outside face of each side member 26 on the upper portion of the side member 26, the dog leg tabs 30 opening towards the front face of the upper section 24.

The rectangular lower section 32 includes parallel posts or side members 34 joined by upper 36 and lower 38 crossbeams at opposite ends of the side members 34. As shown in FIGS. 4 and 5, the upper crossbeam 36 and the lower crossbeam 38 are not coplanar with the side members 34, but are joined to the rear face of the side members 34. The crossbeams 36 and 38 and the side members 34 are preferably made from hollow, square steel tubes. Dog leg tabs 30 are attached to the outside face of each side member 34 on the upper portion and lower portions of the side members 34, the dog leg tabs 30 opening towards the front face of the lower section 32. In practice, metal panels (not shown) may be friction fit into the dog leg tabs 30 and nailed to the ribs W of the mine to secure the mine stopping 10 laterally. Alternatively, the tabs 30 may be lengthened and nailed directly to the ribs W.

The outside perimeter of the side members 26 of the upper section 24 is slightly smaller than the inside perimeter of the side members 34 of the lower section 32 so that the side members 26 of the upper section 24 are slidable in the side members 34 of the lower section 32 in telescoping manner. The height of the panel may be fixed by a locking member, which may be a continuously threaded bolt 39 or a friction bolt 42. Both alternatives are shown in FIG. 4. The continuously threaded bolt 39 is an elongated bolt which extends through the crossbeam 28 of the upper section 24 and the upper crossbeam 36 of the lower section 32. A locking nut 40 may be adjusted to set the height of the upper section 24 by preventing the upper section 24 from sliding down into the lower section 32, thereby maintaining sufficient tension against the roof R and floor F to keep the mine stopping 10 fixed in place. With the friction bolt 42, on the other hand, a hole is defined in the inside face of the side members 34 and a nut 43 is welded to the inside face. The side member 26 of the upper section 24 is adjusted to the desired height, and a bolt 42 is inserted through the nut 43 and the hole defined in the lower side member 34 until the end of the bolt 42 lodges against the upper side member 26 and clamps the two telescoping members together, thereby maintaining sufficient tension against the roof R and floor F to keep the mine stopping 10 fixed in place. The friction bolt 42 has the advantage of permitting some slippage in case of sagging of the roof R or heaving of the floor F of the mine, thereby preventing buckling and deformation of the mine stopping 10.

The sheet material which is disposed on the panel frames may be metal, a light weight concrete treated with a flame retardant sealant, or a composite material approved by MSHA. In a preferred embodiment, the sheet material is made from steel. As shown in FIG. 1, the sheet material may be a corrugated material. The sheet material in the lower sections 32 of panels 20 and 22 is a corrugated decking material 44 of the type commonly used as an underlay or reinforcement in concrete floors, having rectangular hills and valleys. The sheet material in the upper section 24 of the panels 20 and 22 has an upper portion 46 of corrugated material of the type used in shed roofs, having arcuate hills and valleys, and a flat lower portion 48. Only the upper portion is fixed to the side members 26, the lower portion 48 frictionally engaging the side members 26 and being flexible enough to bend slightly rearward to frictionally engage the corrugated decking 44 of the lower section 32. As seen in FIG. 5, the flat lower portion 48 is slidable through a gap between the corrugated decking 44 forming the sheet material of the lower section 32 and the upper crossbeam 36 of the lower section frame. A shim 49 may be placed between the upper frame side member 26 and crossbeam 28 to displace the upper section sheet material rearward in order to position the flat lower portion 48 so that it is slidable between the corrugated decking 44 and the crossbeam 36. The engagement between the flat lower portion 48 and the corrugated decking 44 is frictional, so that no sealant is ordinarily required between the upper section 24 and the lower section 32.

Figure 8:
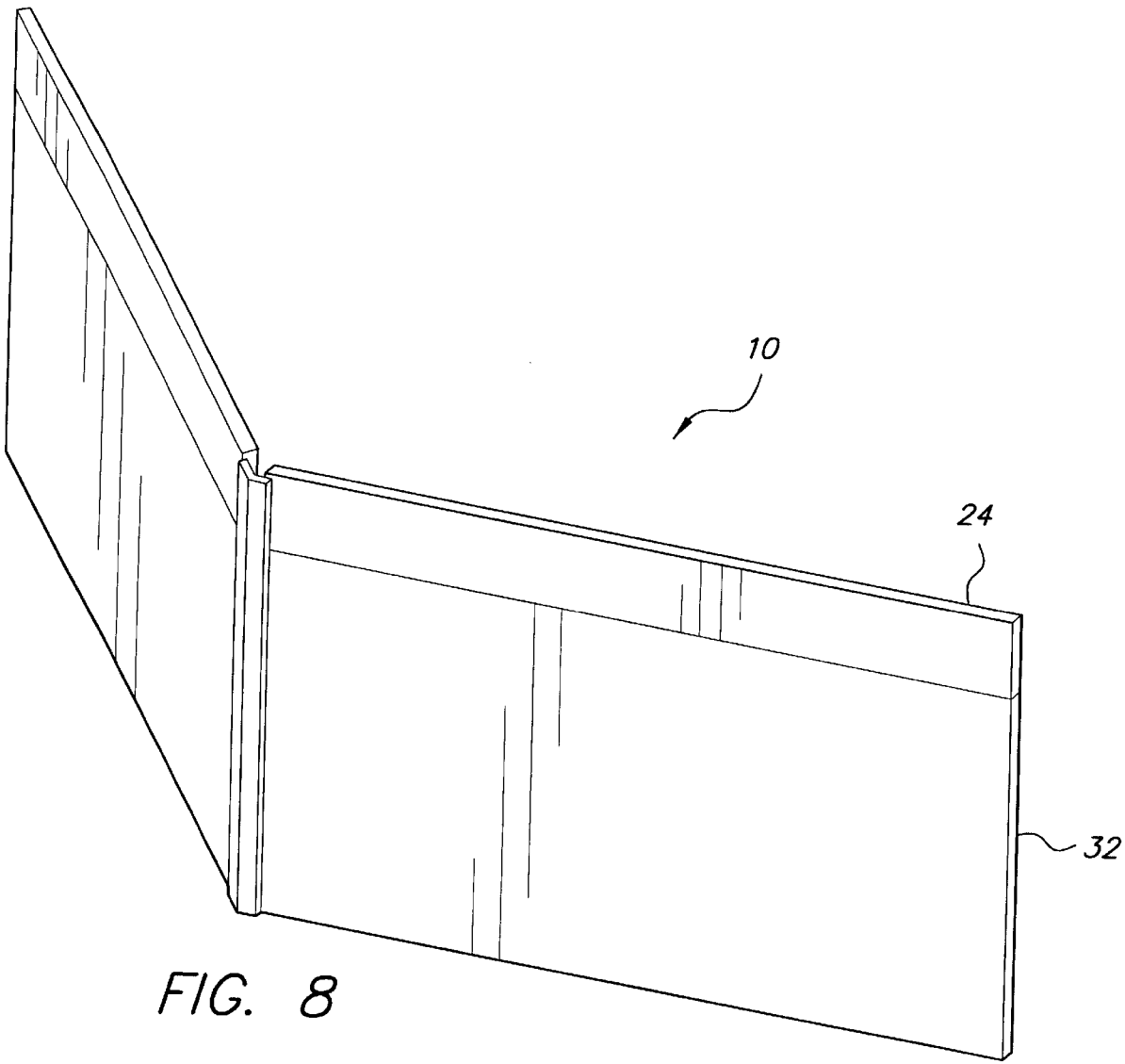
FIG. 8 is a perspective view of another embodiment of a hinged mine stopping according to the present invention with flat panels.

The use of corrugated sheet material in the upper 24 and lower sections 32 of the panels 20 and 22 increase the load resistance of the hinged mine stopping 10, render the stopping 10 suitable for use as a permanent ventilation control device. In the alternative, the sheet material in the upper 24 and lower 32 sections may be flat sheet material, as shown in FIG. 8.

Figure 6:
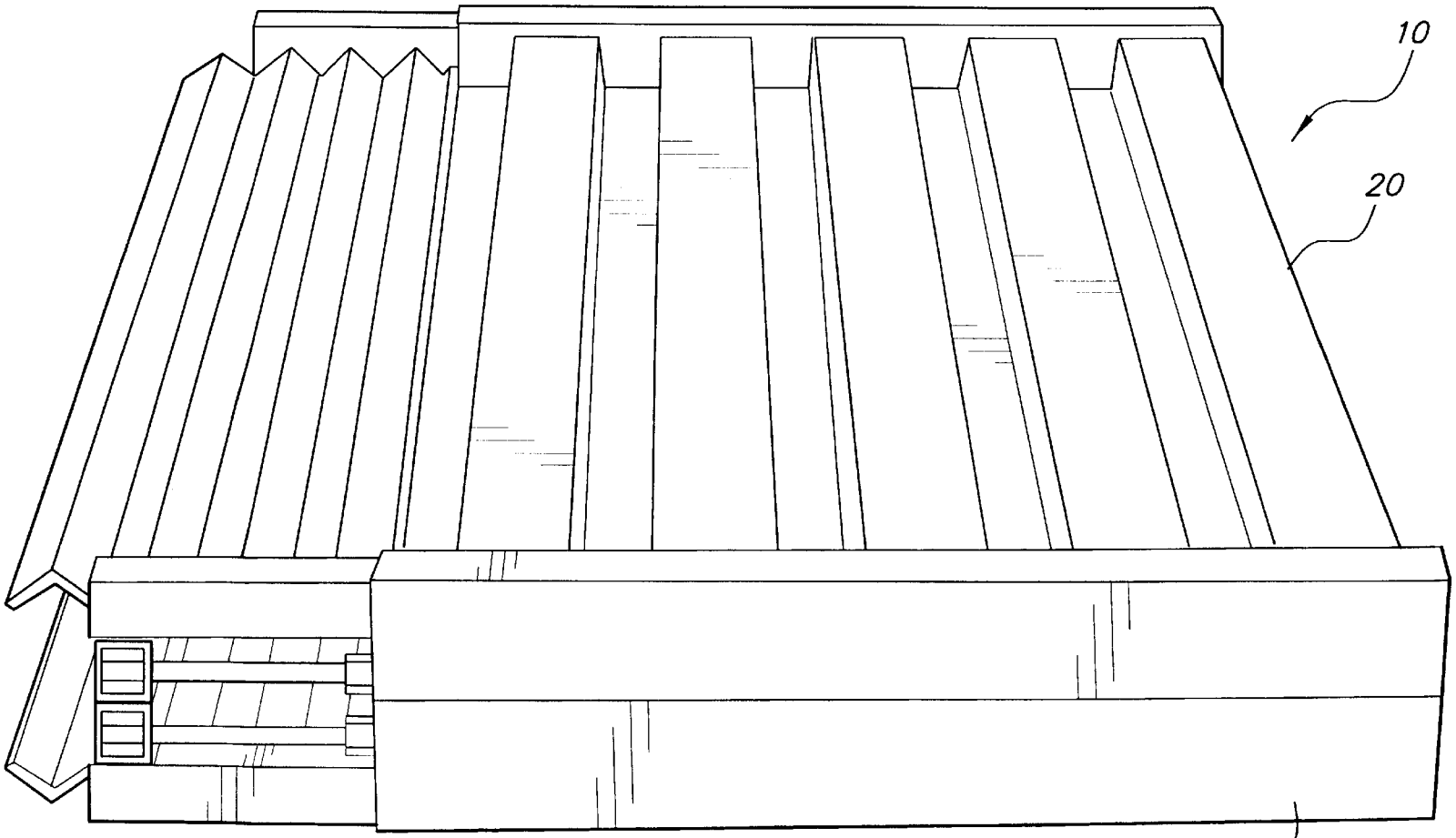
FIG. 6 is a perspective view of the hinged mine stopping according to the present invention folded for transport.

A first embodiment of the hinge 50 is shown in FIGS. 1 and 6. In this embodiment, the hinge 50 is a strap hinge, made from a flexible rectangular metal strap which extends substantially the height of the lower section 32. One side of the strap is welded to a side member 34 of the lower section 32 of the panel 20, and the other side is welded to a side member 34 of the lower section 32 of the panel 22. The strap hinge 50 works in a manner analogous to the spine of a book. As shown in FIG. 6, the strap hinge permits one panel 20 to be folded onto the other panel 22 to leave a compact package profile for transporting the mine stopping 10 into the mine. The strap hinge leaves a gap between the upper sections 24 of the panels 20 and 22. As shown in FIG. 1, this gap may be sealed with a piece of expandable metal 52, such as an angle or channel with flexible flanges, and wedged between the panels 20 and 22 and sealed with an MSHA sealant or filler 60 to make the stopping 10 airtight.

Figure 7:
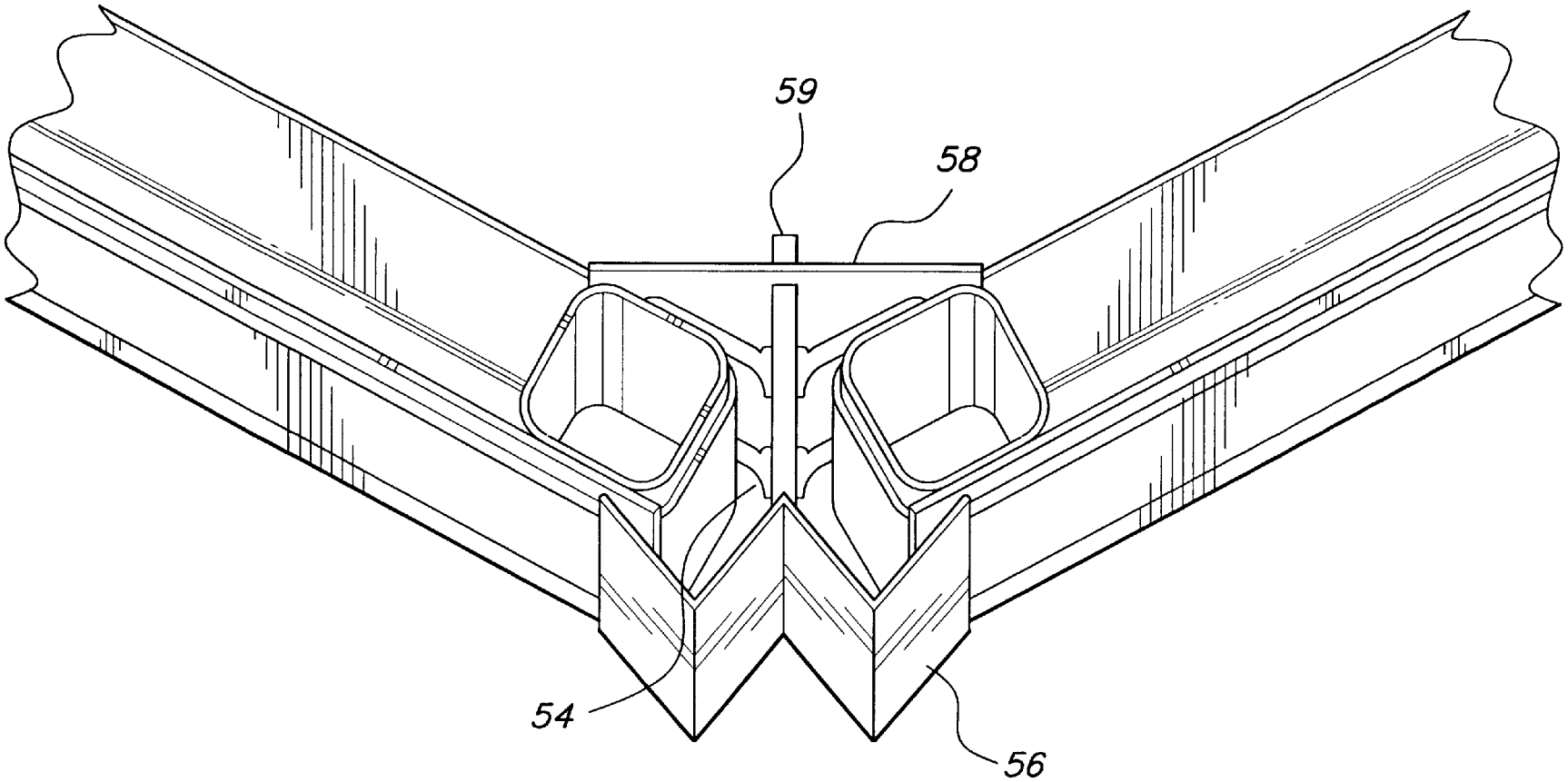
FIG. 7 is a top perspective view of an alternate embodiment of the hinged mine stopping of the present invention showing a different hinge and seal.

An alternative embodiment of the hinge is shown in FIG. 7. In FIG. 7, the hinge is comprised of at least two common door hinges 54, each door hinge having a pair of leaves joined by a pintle or hinge pin. Each hinge 54 has one leaf attached to a side member 34 of the lower section 32 of panel 20, and the other leaf attached to the side member 34 of the lower section 32 of the other panel 22. The hinges 54 are preferably positioned on the upper and lower portions of the lower panel sections 32. It is possible to connect another hinge 54 between the upper sections 24 of the panels 20 and 22; however, a hinge between the upper sections would preclude independent height adjustment of the two panels 20 and 22. It is preferable to have independent height adjustment in order to conform the height of the panels 20 and 22 to irregularities in the height of the roof R.

FIG. 7 also illustrates an alternative seal arrangement which may be used with the hinges 54. The seal is comprised of an elongated metal strip 56 having a W-shaped cross section which is placed over the gap at the juncture of the panels 20 and 22 on the front side of the stopping 10 and one or more planar brace plates 58 placed in rear of the stopping 10. A bolt 59 is placed through the elongated metal strip 56, extends through the gap between panels 20 and 22, and is tightened either in a threaded aperture defined in the brace plate 58, or by a nut placed in rear of the brace plate 58. The elongated, W-shaped metal strip 56 may be cut to length after the mine stopping 10 is erected in the crosscut with tin snips or aviation shears.

It will be seen that the hinged mine stopping 10 of the present invention provides an economical, effective mine ventilation control device offering compact storage for transport and quick and easy installation.

It is to be understood that the present invention is not limited to the embodiments described above, but encompasses any and all embodiments within the scope of the following claims.

I claim:

1. A hinged mine stopping for controlling the flow of air in a mine, comprising:

a) a first panel;

b) a second panel, each said panel having a frame including:

(i) a pair of side members and a crossbeam connecting the side members to define an inverted U-shaped upper section;

(ii) a pair of tubular side members, and an upper crossbeam and a lower crossbeam connecting the tubular side members to define a rectangular shaped lower section, the side members of the upper section being slidably disposed in the tubular side members of the lower section so that the upper section telescopes into the lower section; and (iii) locking means for temporarily preventing sliding movement of the side members of the upper section in the tubular side members of the lower section, whereby said frame is height adjustable;

c) at least one hinge connecting said first and second wall panels; and d) sealing means for sealing said first and second panels against a mine roof, floor and ribs in order to form an airtight seal;

wherein the hinged mine stopping is adapted for being disposed in an air passage in a mine with said first panel at an oblique angle to a rib and said second panel at an oblique angle to an opposing rib to define a V-shaped wall across the air passage.

2. The hinged mine stopping according to claim 1, wherein said first panel and said second panel each further comprise:

(a) an upper sheet of gas impermeable, flame retardant material disposed on said upper section;

(b) a lower sheet of gas impermeable, flame retardant material disposed on said lower section; and (c) wherein said upper sheet includes a flat lower portion slidable between the upper crossbeam and the lower sheet.

3. The hinged mine stopping according to claim 2, wherein said lower sheet and at least a portion of said upper sheet are made from corrugated steel.

4. The hinged mine stopping according to claim 1, wherein said locking means comprises a pair of continuously threaded bolts disposed between the crossbeam of said upper section and the upper crossbeam of said lower section and a nut disposed on each of said bolts.

5. The hinged mine stopping according to claim 1, wherein said locking means comprises a nut attached to each of the tubular side members of said lower section and a bolt extending through said nut and said tubular side member to frictionally engage the side member of said upper section.

6. The hinged mine stopping according to claim 1, wherein said at least one hinge comprises a flexible, rectangular metal strap having a height substantially equal to the height of the tubular side members of said lower section, said strap having a first side attached to one of the tubular side members of said lower section of said first panel, and an opposite side attached to one of the tubular side members of said lower section of said second panel, said strap bending to permit said first panel and said second panel to define an angle between about 0° and 180°.

7. The hinged mine stopping according to claim 1, wherein said at least one hinge comprises a pair of door hinges, each door hinge having a first leaf attached to the tubular side member of the lower section of said first panel and a second leaf attached to the tubular side member of said second panel.

8. The hinged mine stopping according to claim 7, further comprising an elongated metal seal having a W-shape in cross section, said seal being disposed along the hinged joint between said first panel and said second panel in order to block the passage of air through any gaps between said first panel and said second panel.

9. A hinged mine stopping for controlling the flow of air in a mine, comprising:

(a) a first panel and a second panel, each panel having:

(i) a frame having a rectangular lower section and an inverted U-shaped upper section telescoping into the lower section; and (ii) a sheet of gas impermeable, flame retardant material disposed on said frame; and (b) a flexible, rectangular metal strap having a first side attached to the lower section of the frame of said first panel, and an opposing second side attached to the lower section of said second panel, said strap bending to permit said first panel and said second panel to define an angle between about 0° and 180°, said strap blocking the flow of air between the lower sections of said first and second panels;

wherein the hinged mine stopping is adapted for being disposed in an air passage in a mine with said first panel at an oblique angle to a rib and said second panel at an oblique angle to an opposing rib to define a V-shaped wall across the air passage, the telescoping frames of said first and second panel being adjustable against a roof and a floor of the passage to retain the hinged mine stopping in the air passage, the hinged mine stopping being sealed against the roof, floor and ribs to block air flow through the air passage.

10. The hinged mine stopping according to claim 9, wherein each said sheet of gas impermeable, flame retardant material is made from steel.

11. A hinged mine stopping for controlling the flow of air in a mine, comprising:

(a) a first panel and a second panel, each panel having:

(i) a frame having a rectangular lower section and an inverted U-shaped upper section telescoping into the lower section; and (ii) a sheet of gas impermeable, flame retardant material disposed on said frame; and (b) a plurality of door hinges, each of said hinges having a first leaf attached to the lower section of said first panel and a second leaf attached to the lower section of said second panel, said door hinges being pivotable to form an angle between 0° and 180°;

wherein the hinged mine stopping is adapted for being disposed in an air passage in a mine with said first panel at an oblique angle to a rib and said second panel at an oblique angle to an opposing rib to define a V-shaped wall across the air passage, the telescoping frames of said first and second panel being adjustable against a roof and a floor of the passage to retain the hinged mine stopping in the air passage, the hinged mine stopping being sealed against the roof, floor and ribs to block air flow through the air passage.

12. The hinged mine stopping according to claim 11, further comprising an elongated metal seal having a W-shape in cross section, said seal being disposed along the hinged joint between said first panel and said second panel in order to block the passage of air through any gaps between said first panel and said second panel.

13. A hinged mine stopping for controlling the flow of air in a mine, comprising:

(a) a first panel and a second panel, each panel having:

(i) a frame having a rectangular lower section and an inverted U-shaped upper section telescoping into the lower section, said upper section of each frame is made from square steel tubing and includes a pair of side members and a crossbeam joining an end of each side member; and (ii) a sheet of gas impermeable, flame retardant material disposed on said frame; and (b) a hinge means connecting the lower section of said first panel and the lower section of said second panel;

wherein the hinged mine stopping is adapted for being disposed in an air passage in a mine with said first panel at an oblique angle to a rib and said second panel at an oblique angle to an opposing rib to define a V-shaped wall across the air passage, the telescoping frames of said first and second panel being adjustable against a roof and a floor of the passage to retain the hinged mine stopping in the air passage, the hinged mine stopping being sealed against the roof, floor and ribs to block air flow through the air passage.

14. The hinged mine stopping according to claim 13, wherein the lower section of each frame is made from square steel tubing and comprises a pair of side members having an upper end and a lower end, an upper crossbeam connected between the upper end of said side members, and a lower crossbeam connected between the lower ends of said side members, the side members of said upper section having a perimeter slightly smaller than the inside perimeter of the side members of said lower section in order to be slidable therein.

15. The hinged mine stopping according to claim 14, further comprising a pair of spaced apart, continuously threaded bolts extending between the crossbeam of said upper section and the upper crossbeam of said lower section, and a nut disposed on each said bolt above said upper crossbeam, whereby the lower crossbeam may be disposed on a mine floor and the crossbeam of said upper section may be raised against a mine roof, said nuts being tightened to wedge said panel between the mine roof and mine floor.

16. The hinged mine stopping according to claim 14, further comprising a pair of nuts attached to an upper portion of the side members of said lower section and a bolt extending through each nut and side member of said lower section, said bolts being capable of engaging the side members of said upper section to clamp said side members, whereby the lower crossbeam may be disposed on a mine floor and the crossbeam of said upper section may be raised against a mine roof, said bolts being tightened to retain the upper section by friction to wedge said panel between the mine roof and mine floor.

17. A hinged mine stopping for controlling the flow of air in a mine, comprising:

(a) a first panel and a second panel, each panel having:

(i) a frame having a rectangular lower section and an inverted U-shaped upper section telescoping into the lower section; and (ii) a sheet of gas impermeable, flame retardant material disposed on said frame, said material is corrugated; and (b) a hinge means connecting the lower section of said first panel and the lower section of said second panel;

wherein the hinged mine stopping is adapted for being disposed in an air passage in a mine with said first panel at an oblique angle to a rib and said second panel at an oblique angle to an opposing rib to define a V-shaped wall across the air passage, the telescoping frames of said first and second panel being adjustable against a roof and a floor of the passage to retain the hinged mine stopping in the air passage, the hinged mine stopping being sealed against the roof, floor and ribs to block air flow through the air passage.

* * * * *